US010001738B2

(12) United States Patent
Mori

(10) Patent No.: US 10,001,738 B2
(45) Date of Patent: Jun. 19, 2018

(54) IMAGING FORMING APPARATUS TO SWITCH SPEED OF ROLLER PAIRS

(71) Applicant: CANON KABUSHIKI KAISHA, Tokyo (JP)

(72) Inventor: Eiko Mori, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/256,370

(22) Filed: Sep. 2, 2016

(65) Prior Publication Data

US 2017/0068194 A1 Mar. 9, 2017

(30) Foreign Application Priority Data

Sep. 8, 2015 (JP) ..... 2015-176861

(51) Int. Cl.
*G03G 15/00* (2006.01)
*B65H 29/00* (2006.01)

(52) U.S. Cl.
CPC ..... *G03G 15/6529* (2013.01); *B65H 29/00* (2013.01); *G03G 15/50* (2013.01); *G03G 15/6552* (2013.01); *G03G 2215/00945* (2013.01); *G03G 2215/00949* (2013.01)

(58) Field of Classification Search
CPC .... B65H 29/00; G03G 15/50; G03G 15/6529; G03G 15/6552; G03G 2215/00945; G03G 2215/00949
See application file for complete search history.

(56) References Cited

U.S. PATENT DOCUMENTS

2004/0230336 A1* 11/2004 Matsumoto ..... B65H 5/34 700/223
2010/0239296 A1* 9/2010 Kimura ..... G03G 15/234 399/68
2015/0014916 A1* 1/2015 Saito ..... B65H 31/3018 271/185
2017/0050812 A1* 2/2017 Mukai ..... B65H 3/46

FOREIGN PATENT DOCUMENTS

JP 2004333634 A * 11/2004
JP 2009-057169 A 3/2009

* cited by examiner

*Primary Examiner* — Francis Gray
(74) *Attorney, Agent, or Firm* — Canon U.S.A., Inc. IP Division

(57) ABSTRACT

An image forming apparatus includes an image forming unit to form an image on a sheet while conveying the sheet at an image forming speed, a discharge roller pair to discharge the sheet, a conveyance roller pair to convey the sheet from the image forming unit to the discharge roller pair, and a control unit to control a motor to switch a speed of the conveyance roller pair and the discharge roller pair between a first speed corresponding to the image forming speed and a second speed higher than the first speed. In first control, the speed is switched from the second to the first speed at timing at which a trailing end of the sheet reaches a first position. In second control, the speed is switched from the second to the first speed at timing at which a leading end of a subsequent sheet reaches a second position.

19 Claims, 9 Drawing Sheets

FIG. 3

| SHEET SIZE GROUP | LENGTH IN CONVEYANCE DIRECTION | PRODUCTIVITY |
|---|---|---|
| GROUP 1 | 215.9 mm OR LESS | 60 SHEETS/min |
| GROUP 2 | 215.9 mm OR MORE AND 297 mm OR LESS | 50 SHEETS/min |
| GROUP 3 | 297 mm OR MORE AND 364 mm OR LESS | 30 SHEETS/min |
| GROUP 4 | 364 mm OR MORE AND 431.8 mm OR LESS | 20 SHEETS/min |
| GROUP 5 | 431.8 mm OR MORE | 10 SHEETS/min |

IMAGING FORMING APPARATUS TO SWITCH SPEED OF ROLLER PAIRS

BACKGROUND OF THE INVENTION

Field of the Invention

The present invention relates to an image forming apparatus which forms an image on a sheet.

Description of the Related Art

In an image forming apparatus, such as a copier and a printer, a sheet with an image formed thereon is discharged to a sheet stacking unit by a discharge roller pair. In an image forming apparatus, a discharge roller pair conveys a sheet with an image formed thereon in an accelerated state, and then releases the sheet toward a sheet stacking unit in a decelerated state (see Japanese Patent Laid-Open No. 2009-57169). The sheet is accelerated once to shorten the printing time. The sheet is released toward the sheet stacking unit in a decelerated state to improve stackability (alignment property) in the sheet stacking unit. The sheet is accelerated once also to elongate a distance from a subsequent sheet to detect the subsequent sheet reliably.

While the discharge roller pair is conveying the preceding sheet at a high speed, the subsequent sheet is conveyed by an image forming unit at an image forming speed (a low speed). If the discharge roller pair and the conveyance roller pair located upstream of the discharge roller pair in the conveyance direction are to be driven by the same motor to reduce the cost, the following problem may occur. Control of the motor to accelerate the discharge roller pair conveying the preceding sheet also accelerates the conveyance roller pair. The accelerated conveyance roller pair cannot receive the subsequent sheet that is fed at a lower speed from the image forming unit.

SUMMARY OF THE INVENTION

According to an aspect of the present invention, an image forming apparatus includes an image forming unit configured to form an image on a sheet while conveying the sheet at an image forming speed, a discharge roller pair configured to discharge the sheet on which the image is formed by the image forming unit, a conveyance roller pair disposed between the image forming unit and the discharge roller pair, and configured to convey the sheet from the image forming unit to the discharge roller pair, a motor configured to drive the discharge roller pair and the conveyance roller pair, and a control unit configured to control the motor to switch a speed of the conveyance roller pair and the discharge roller pair between a first speed corresponding to the image forming speed and a second speed which is higher than the first speed, wherein the control unit is configured to perform first control and second control, wherein, in first control, the motor is controlled in a manner such that the speed of the conveyance roller pair and the discharge roller pair is switched from the second speed to the first speed at timing at which a trailing end of the sheet conveyed by the discharge roller pair reaches a first position between the discharge roller pair and the conveyance roller pair, and wherein, in second control, the motor is controlled in a manner such that the speed of the conveyance roller pair and the discharge roller pair is switched from the second speed to the first speed at timing at which a leading end of a subsequent sheet fed following a preceding sheet conveyed by the discharge roller pair reaches a second position upstream of the conveyance roller pair.

Further features of the present invention will become apparent from the following description of exemplary embodiments with reference to the attached drawings.

BRIEF DESCRIPTION OF THE DRAWINGS

FIG. 3 is diagram illustrating productivity of each sheet size group.

DESCRIPTION OF THE EMBODIMENTS

First Embodiment

Figure 1:
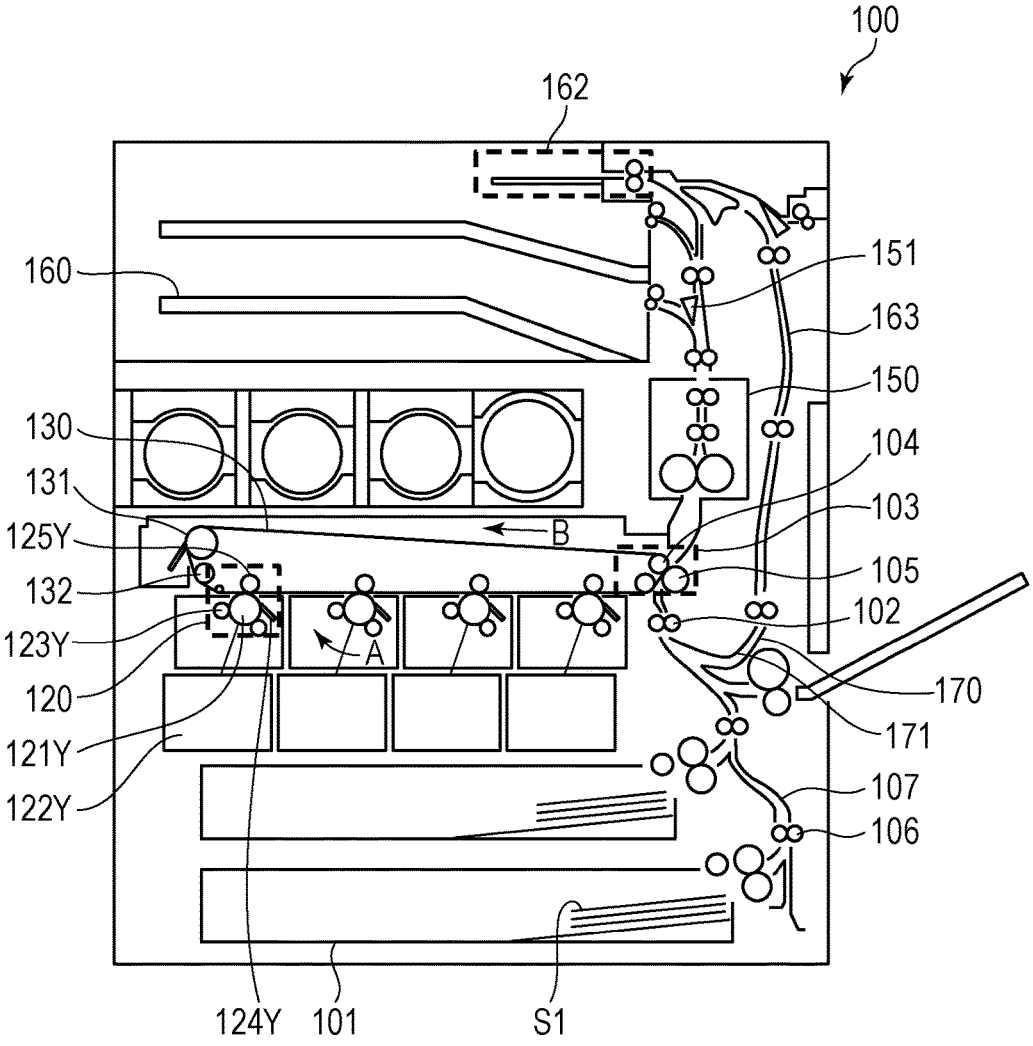
FIG. 1 is a cross-sectional view of an image forming apparatus.

FIG. 1 is a cross-sectional view of an image forming apparatus 100 according to an embodiment of the present invention.

Sheets S1 are stacked in a lift-up tray of a container 101. The sheet S1 in the container 101 is sent out by a feeding mechanism. The sheet S1 sent out by the feeding mechanism is conveyed on a feeding path 107 by feeding rollers 106. Skew feeding of the sheet S1 conveyed on the feeding path 107 is corrected by a registration roller pair 102. The sheet S1 of which skew feeding is corrected by the registration roller pair 102 is conveyed by the registration roller pair 102 to a secondary transfer portion 103.

The secondary transfer portion 103 is a transfer nip portion formed by a secondary transfer inner roller 104 and an external secondary transfer roller 105. In the secondary transfer portion 103, a toner image is transferred to a surface of the conveyed sheet S1.

Next, an image formation process for forming the toner image to be transferred to the sheet S1 at the secondary transfer portion 103 is described. Four image formation units 120 for forming the toner images of yellow (Y), magenta (M), cyan (C) and black (Bk) in the example of FIG. 1 are provided. The number of colors is not limited to four and the order of arrangement of colors is not limited to the same.

The four image formation units are the same in configuration and each of them forms a toner image of each color. Here, a configuration of an image formation unit 120 which forms a yellow toner image is described.

The image formation unit 120 includes a photoconductor 121Y, an unillustrated charging unit, an exposure mechanism 122Y, a developing unit 123Y, a primary transfer mechanism 125Y, and a photoconductor cleaner 124Y.

The exposure mechanism 122Y irradiates a surface of the photoconductor 121Y with laser light in accordance with image signals. The surface of the photoconductor 121Y is charged uniformly by the charging unit in advance. The photoconductor 121Y is rotated in the direction of arrow A in FIG. 1. Upon irradiation with laser light, an electrostatic latent image is formed on the surface of the photoconductor 121Y.

The electrostatic latent image formed on the photoconductor 121Y is developed by the developing unit 123Y. The toner image is thus formed on the photoconductor 121Y. The toner image on the photoconductor 121Y is transferred to an intermediate transfer belt 130 by the primary transfer mechanism 125Y. Transfer residual toner slightly remaining on the photoconductor 121Y is collected by the photoconductor cleaner 124Y.

The intermediate transfer belt 130 is stretched over a driving roller 131, a secondary transfer inner roller 104, a tension roller 132 and other rollers, and is driven in the direction of arrow B in FIG. 1. The image formation process of each color is conducted in parallel by each of the image formation units 120 of Y, M, C and Bk at timing at which upstream toner images primarily transferred to the intermediate transfer belt 130 are registered each other. Finally, a full color toner image is formed on the intermediate transfer belt 130 and is conveyed to the secondary transfer portion 103. In the secondary transfer portion 103, the full color toner image is transferred to the sheet S1.

The sheet S1 to which the toner image is transferred in the secondary transfer portion 103 is conveyed to a fixing apparatus 150. In the fixing apparatus 150, the toner image transferred to the sheet S1 is melt and fixed to the sheet S1. The sheet S1 with the thus obtained fixed image is discharged onto a discharge tray 160 as a sheet stacking unit in which the sheets S1 are stacked.

If an image is to be formed also on the back side of the sheet S1, the sheet S1 is guided by a swing guide 151 to a reverse conveyance mechanism 162. The sheet S1 is conveyed from the reverse conveyance mechanism 162 to a double-sided printing conveying mechanism 163, and is again conveyed to the registration roller pair 102.

Figure 4:
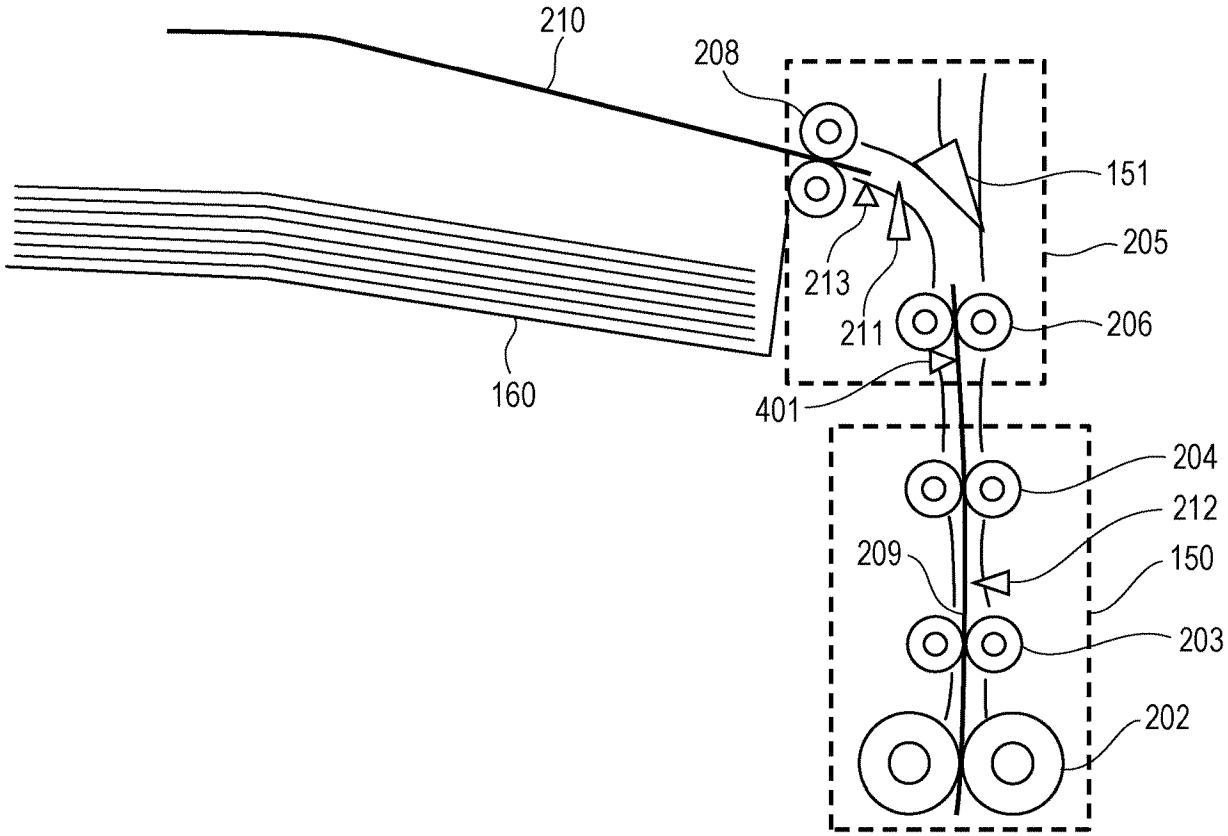
FIG. 4 is a cross-sectional view illustrating a configuration related to sheet discharging.

FIG. 4 illustrates a configuration of the fixing apparatus 150 and a configuration of a discharge unit 205 which conveys the sheet S1, to which an image is fixed by the fixing apparatus 150, to the discharge tray 160. A discharge apparatus which discharges the sheet S1 is constituted by the fixing apparatus 150 and the discharge unit 205.

The fixing apparatus 150 includes a fixing roller pair (a fixing rotor pair) 202 which fixes the toner image transferred to the sheet S1 with heat and pressure to the sheet S1. The fixing apparatus 150 further includes first post fixing rollers 203 and second post fixing rollers 204 which are disposed downstream of the fixing roller pair 202 in the sheet conveying direction and convey the sheet S1. The fixing apparatus 150 fixes the toner image to the sheet S1 while conveying the sheet S1 at a fixing speed as an image forming speed.

In the present embodiment, an image forming unit which forms an image on the sheet S1 while conveying the sheet S1 at the image forming speed is constituted by the image formation unit 120, the intermediate transfer belt 130, and the fixing apparatus 150.

Driving force from a motor is transmitted to the second post fixing rollers 204 via a one way clutch. Therefore, by conveying the sheet S1 at a speed higher than the conveyance speed of the second post fixing rollers 204, a discharge unit 205 disposed downstream of the second post fixing rollers 204 can convey the sheet S1 in a manner such that the sheet S1 is drawn out of the second post fixing rollers 204.

The discharge unit 205 includes a relay roller pair 206 as a conveyance roller pair which is disposed downstream of the second post fixing rollers 204 and conveys the sheet S1. The discharge unit 205 includes a discharge roller pair 208 which is disposed downstream of the relay roller pair 206 in the sheet conveying direction and discharges the sheet S1 onto the discharge tray 160. The relay roller pair 206 and the discharge roller pair 208 are driven by the same driving motor (a discharge motor).

The swing guide 151 is provided between the relay roller pair 206 and the discharge roller pair 208. The swing guide 151 is a guide portion capable of moving to a position to guide the sheet S1 conveyed by the relay roller pair 206 toward the discharge roller pair 208 and a position to guide the sheet S1 upward.

A discharge sensor 211 for detecting the sheet S1 is provided between the relay roller pair 206 and the discharge roller pair 208. The discharge sensor 211 generates an ON signal upon detection of a sheet S1 and generates an OFF signal upon non-detection of any sheet S1.

The sheets S1 on which an image is formed are stacked on the discharge tray 160 through the fixing apparatus 150 and the discharge unit 205. The discharging operation of the sheet S1 by the discharge unit 205 is described later.

In the image forming apparatus, productivity is set for each size group of the sheet S1 as illustrated in FIG. 3. The distance between sheets in the conveyance direction in the same size group vary depending on the length of the sheet S1. The distance between sheets here is a distance from the trailing end of a preceding sheet to a leading end of a subsequent sheet.

Figure 2:
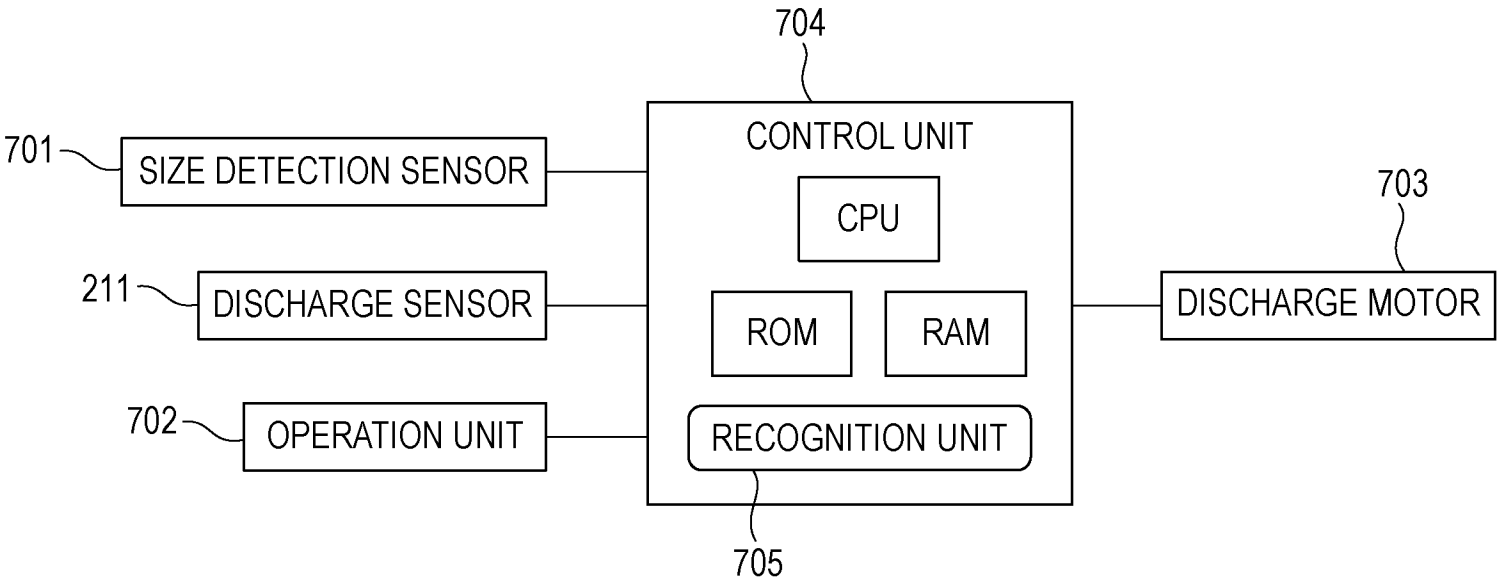
FIG. 2 is a block diagram of the image forming apparatus.

FIG. 2 is a control block diagram of the image forming apparatus. Signals from a size detection sensor 701 which is disposed in the container 101 and detects the size of the sheet S1 stored in the container 101, and signals from the discharge sensor 211 are input in a control unit 704. An operation unit 702 used for the user operation is further connected to the control unit 704. A discharge motor 703 which drives the relay roller pair 206 and the discharge roller pair 208 is connected to the control unit 704. The control unit 704 accelerates and decelerates the relay roller pair 206 and the discharge roller pair 208 by controlling operation of the discharge motor 703. The control unit 704 includes a recognition unit 705 which recognizes the length of the sheet S1 on the basis of the signals from the operation unit 702 or the size detection sensor 701. Unillustrated loads, such as motors which drive the image formation unit 120 and the fixing apparatus 150, are connected to the control unit 704.

Figure 5:
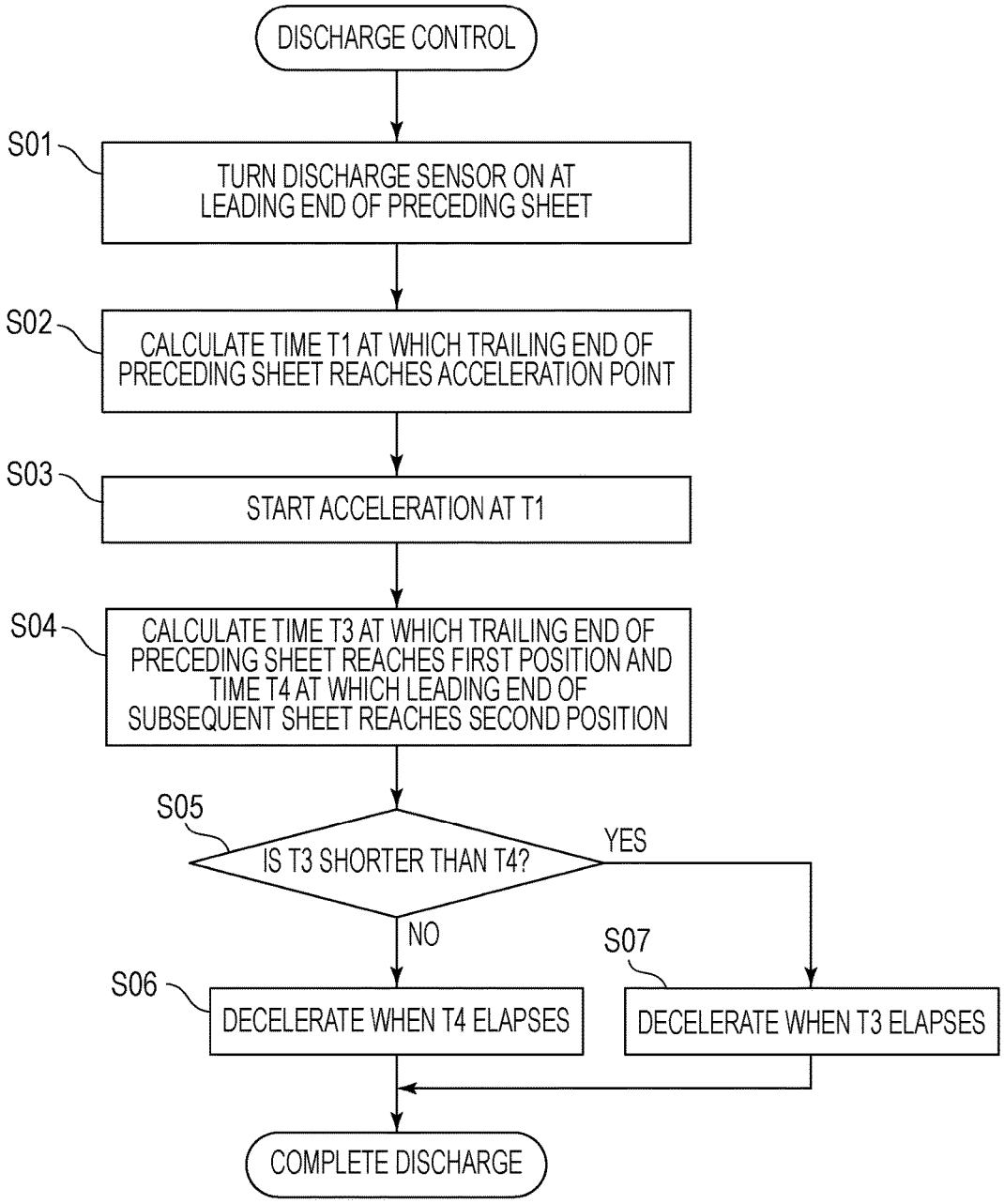
FIG. 5 is a flowchart of control related to a discharging operation of a sheet.

The control unit 704 controls the flowchart of FIG. 5 with a CPU using RAM as a workspace in accordance with a program stored in ROM. Hereafter, control related to the discharging operation of the sheet S1 conducted by the control unit 704 is described with reference to the flowchart of FIG. 5.

The control unit 704 controls the discharge motor 703 so that the conveyance speed of the relay roller pair 206 and the discharge roller pair 208 becomes a speed corresponding to the conveyance speed (the image forming speed) of the fixing apparatus 150 (a first speed). In the present embodiment, the first speed of the relay roller pair 206 and the discharge roller pair 208 is the same as the image forming speed. The first speed is, however, not necessarily the same as the image forming speed. The first speed may be slightly higher or lower than the image forming speed as long as no image defect occurs or the sheet S1 is not damaged when the sheet S1 being conveyed by the fixing apparatus 150 at the image forming speed is conveyed by the relay roller pair 206 and the discharge roller pair 208.

The control unit 704 confirms that the discharge sensor 211 is turned on by a leading end of a preceding sheet 210 conveyed by the fixing apparatus 150 and the relay roller pair 206 (S01). On the basis of the length of the sheet S1 in the conveyance direction, the control unit 704 calculates time T1 after the discharge sensor 211 is turned on, until the trailing end of the sheet S1 reaches an acceleration point 212 which is a predetermined position (S02). When the predicted time T1 elapses after the discharge sensor 211 is turned on and the trailing end of the preceding sheet 210 reaches the acceleration point 212, the control unit 704 accelerates the discharge motor 703 (S03). That is, the control unit 704 controls the discharge motor 703 in S03 so that the conveyance speed of the relay roller pair 206 and the discharge roller pair 208 is increased (changed) to a second speed from the first speed (S03). The sheet S1 is conveyed at the second speed, while being drawn out of the second post fixing rollers 204 by the relay roller pair 206 and the discharge roller pair 208 which have been accelerated. The control unit 704 determines the length of the sheet S1 on the basis of user input from the operation unit 702 or by the signals from the size detection sensor 701.

The control unit 704 calculates predicted time T3 after the leading end of the preceding sheet 210 turns the discharge sensor 211 on, until the trailing end of the preceding sheet 210 reaches a first position 213 (S04). The control unit 704 calculates predicted time T4 after the leading end of the preceding sheet 210 turns the discharge sensor 211 on, until a leading end of a subsequent sheet 209 reaches a second position 401 (S04). The first position 213 is a position between the relay roller pair 206 and the discharge roller pair 208, and is a position immediately upstream of the discharge roller pair 208 in the present embodiment (see FIG. 4). The second position 401 is upstream of the relay roller pair 206 in the conveyance direction (see FIG. 4).

On the basis of the size of the sheet S1 set in advance, the control unit 704 calculates the predicted time T3 in which the trailing end of the preceding sheet 210 reaches the first position 213 after the leading end of the preceding sheet 210 turns the discharge sensor 211 on. On the basis of the size of the sheet S1 and the distance between sheets set in advance, the control unit 704 calculates the predicted time T4 in which the leading end of the subsequent sheet 209 reaches the second position 401 after the leading end of the preceding sheet 210 turns the discharge sensor 211 on. As described above, the size of the sheet S1 is set in advance in response to the user input from the operation unit 702 or on the basis of the signals from the size detection sensor 701 in the container 101.

The control unit 704 compares the predicted time T3 with the predicted time T4 (S05). If the predicted time T3 is shorter than the predicted time T4 (S05: YES), the control unit 704 decelerates the discharge motor 703 when control unit 704 determines that the predicted time T3 elapsed after the discharge sensor 211 is turned on (S07). If the predicted time T4 is shorter than the predicted time T3 (S05: NO), the control unit 704 decelerates the discharge motor 703 when control unit 704 determines that the predicted time T4 elapsed after the discharge sensor 211 is turned on (S06). The control unit 704 decelerates the discharge motor 703 so that the conveyance speed after deceleration of the relay roller pair 206 and the discharge roller pair 208 becomes the first speed which corresponds to the conveyance speed (the image forming speed) of the fixing apparatus 150.

The sheet is discharged by the decelerated discharge roller pair 208 onto the discharge tray 160. Therefore, stackability of the sheets onto the discharge tray 160 is favorable. The same control is conducted about sheets following the subsequent sheet 209.

Operations and effects of the above-described discharge control of the sheet are described with reference to the schematic diagrams of FIGS. 6A to 6E.

Figure 6A:
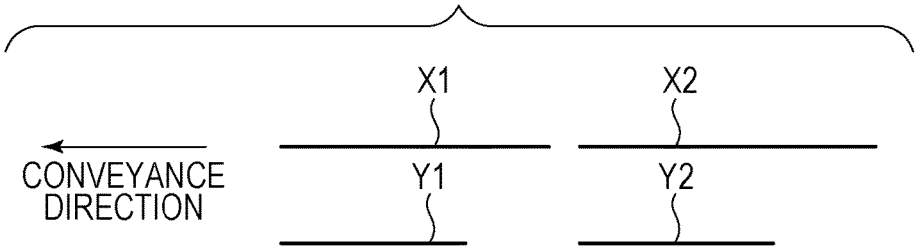
FIGS. 6A to 6E are explanatory views illustrating an operation related to the discharging operation of a sheet.

As described above, productivity is the same in the same size group. Therefore, the distance between sheets varies depends on the size (the length) of the sheet in the conveyance direction. FIG. 6A schematically illustrates positions of long sheets X1 and X2 and short sheets Y1 and Y2 which belong to the same size group immediately after being sent out of the container 101. As illustrated in FIG. 6A, the distance between the long sheets X1 and X2 is shorter than the distance between short sheets Y1 and Y2.

Figure 6B:
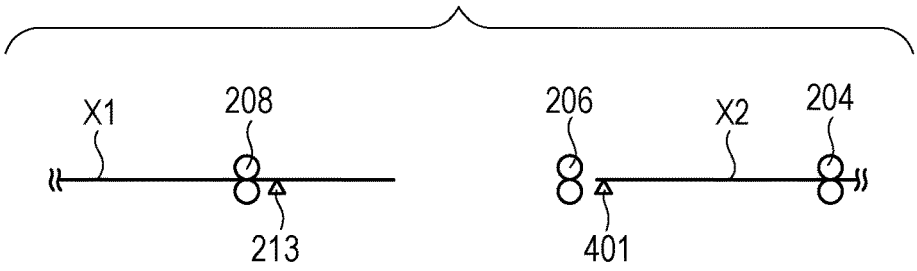

FIG. 6B schematically illustrates positions of the long sheets X1 and X2 at timing at which the preceding sheet is decelerated in a case in which the image forming apparatus conveys the long sheets X1 and X2 in the present embodiment. When the subsequent long sheet X2 reaches the second position 401, the preceding long sheet X1 (the discharge motor 703) is decelerated.

Figure 6C:
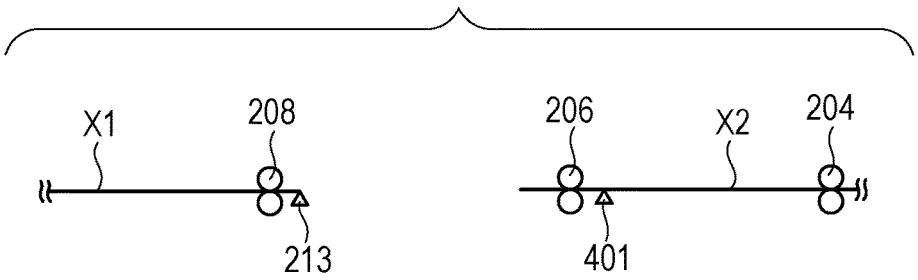

FIG. 6C illustrates an assumed state in which the long sheets X1 and X2 are fed with the discharge motor 703 being operated at a high speed until the trailing end of the preceding long sheet X1 reaches the first position 213. In this case, the subsequent long sheet X2 is already nipped by the relay roller pair 206. This is because the distance between the preceding long sheet X1 and the subsequent long sheet X2 is short (see FIG. 6A). When the relay roller pair 206 is at the second speed which is higher than the conveyance speed of the fixing apparatus 150 before the relay roller pair 206 is decelerated, the subsequent long sheet X2 conveyed at the conveyance speed of the fixing apparatus 150 is nipped by the relay roller pair 206. In this case, since the subsequent long sheet X2 is nipped simultaneously by the relay roller pair 206 rotated at a high speed, and the first and the second post fixing rollers 204 and 203 and the fixing roller pair 202 rotated at a low speed, the sheet X2 is pulled to be damaged or the image may be broken.

In the present embodiment, as illustrated in FIG. 6B, the preceding long sheet X1 is decelerated when the subsequent long sheet X2 reaches the second position 401 which is immediately upstream of the relay roller pair 206.

Figure 6D:
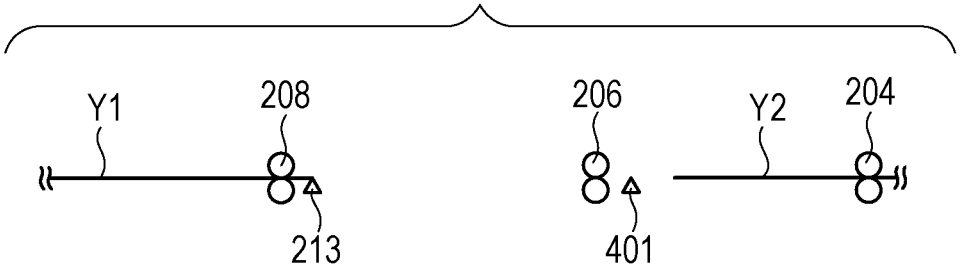

FIG. 6D schematically illustrates positions of the sheets at timing at which the sheets are decelerated in a case in which the image forming apparatus conveys the short sheets Y1 and Y2 in the present embodiment. When the trailing end of the preceding short sheet Y1 reaches the first position 213 (immediately upstream of the discharge roller pair 208), the preceding short sheet Y1 (the discharge motor 703) is decelerated.

Figure 6E:
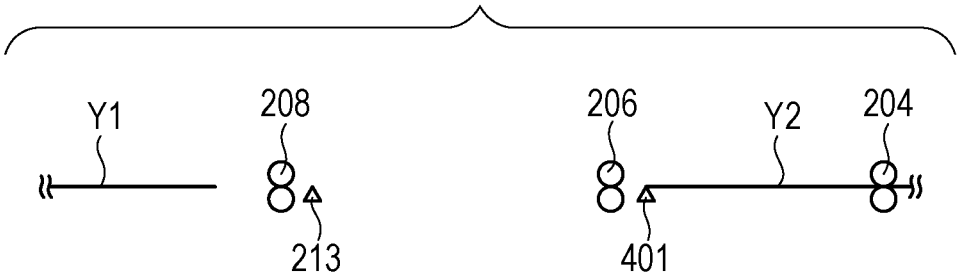

FIG. 6E illustrates an assumed state in which the short sheets Y1 and Y2 are fed with the discharge motor 703 being operated at a high speed until the leading end of the subsequent short sheet Y2 reaches the second position 401. In this case, the trailing end of the preceding short sheet Y1 is already released from the discharge roller pair 208. This is because the distance between the preceding short sheet Y1 and the subsequent short sheet Y2 is long (see FIG. 6A). That is, when the discharge roller pair 208 is rotated at the higher second speed, the preceding short sheet Y1 is released from the discharge roller pair 208 onto the discharge tray 160. Therefore, stackability (alignment property) in the discharge tray 160 becomes worse. Release of the sheet from the discharge roller pair 208 onto the discharge tray 160 here means that the trailing end of the sheet to be discharged passes through the nip of the discharge roller pair 208.

In the present embodiment, as illustrated in FIG. 6D, the preceding short sheet Y1 (the discharge motor 703) is decelerated when the trailing end of the preceding short sheet Y1 reaches the first position 213 (immediately upstream of the discharge roller pair 208).

The above-described control to decelerate the discharge motor 703 when the trailing end of the preceding sheet reaches the first position 213 is referred to as first control. Control to decelerate the discharge motor 703 when the leading end of the subsequent sheet reaches the second position 401 is referred to as second control. In the present embodiment, the following conditions (1) and (2) are satisfied by selectively conducting the first control and the second control depending on the length of the sheet in the conveyance direction.

Condition (1): at the time at which the sheet is released from the discharge roller pair 208 (i.e., when the trailing end of the sheet passes through the discharge roller pair 208), a speed change to the low speed (the first speed) of the accelerated discharge roller pair 208 has been completed.

Condition (2): at the time at which the subsequent sheet fed following the preceding sheet conveyed by the discharge roller pair 208 reaches the relay roller pair 206, a speed change to the low speed (the first speed) of the accelerated relay roller pair 206 has been completed.

In order to satisfy both the conditions (1) and (2) only by the first control, it is necessary to increase the speed during acceleration or to enlarge the distance between the preceding sheet and the subsequent sheet. Higher speed during acceleration may produce larger operation noise. A greater distance between sheets may reduce productivity.

In the present embodiment, the first control and the second control are conducted selectively. Therefore, in the present embodiment, the printing time can be shortened by the acceleration and stackability of the sheets can be improved by the condition (1) without excessively increasing the acceleration speed or shortening the distance between the sheets.

In the embodiment described above, the control unit 704 calculates the predicted time T3 after the leading end of the preceding sheet 210 turns the discharge sensor 211 on, until the trailing end of the preceding sheet 210 reaches the first position 213. The control unit 704 calculates the predicted time T4 after the leading end of the preceding sheet 210 turns the discharge sensor 211 on, until the leading end of the subsequent sheet 209 reaches the second position 401. The control unit 704 determines either of the first control or the second control is to be conducted by comparing the lengths of the predicted time T3 and the predicted time T4 which are calculated. Alternatively, for example, a table of correlations between the length of the sheet and either of the first control or the second control is to be conducted may be stored in the ROM, and the control unit 704 may determine either the first control or the second control is to be conducted on the basis of the length of the sheet being conveyed with reference to the table. For example, in the group 1 (sheets of 215.9 mm or less in length) of the table of FIG. 3, the first control is conducted on the sheet shorter than a threshold value and the second control is conducted on the sheet longer than a threshold value with a predetermined length as a threshold value. In the group 2, the first control is conducted on the sheet shorter than a threshold value and the second control is conducted on the sheet longer than a threshold value with another predetermined length as a threshold value. In the group 3, the first control is conducted on the sheet shorter than a threshold value and the second control is conducted on the sheet longer than a threshold value with even another predetermined length as a threshold value. These configurations may be employed.

In the above description, the control unit 704 calculates in S04 the predicted time T4 on the basis of the length of the sheet and the distance between sheets. Alternatively, the control unit 704 may read the predicted time T4 which is calculated in advance for each size group and is stored in the ROM.

In the above description, the apparatus can process a plurality of size groups of the same productivity. Alternatively, the apparatus may process a single group of the same productivity. For example, the present invention is applicable also to an apparatus which only processes a sheet of the size corresponding to the group 1 of FIG. 3 (sheets of 215.9 mm or less in length) and conducts image formation at the productivity of 60 sheets per minute, and does not process sheets longer than 215.9 mm.

If the sheet conveyed by the discharge roller pair 208 is the last sheet (i.e., if there is no following sheet), the first control is conducted to decelerate at timing at which the trailing end of the last sheet reaches the first position 213 even if the last sheet is the long sheet which should be subject to the second control. This is to release the last sheet onto the discharge tray 160 as promptly as possible by increasing the acceleration time.

Figure 7:
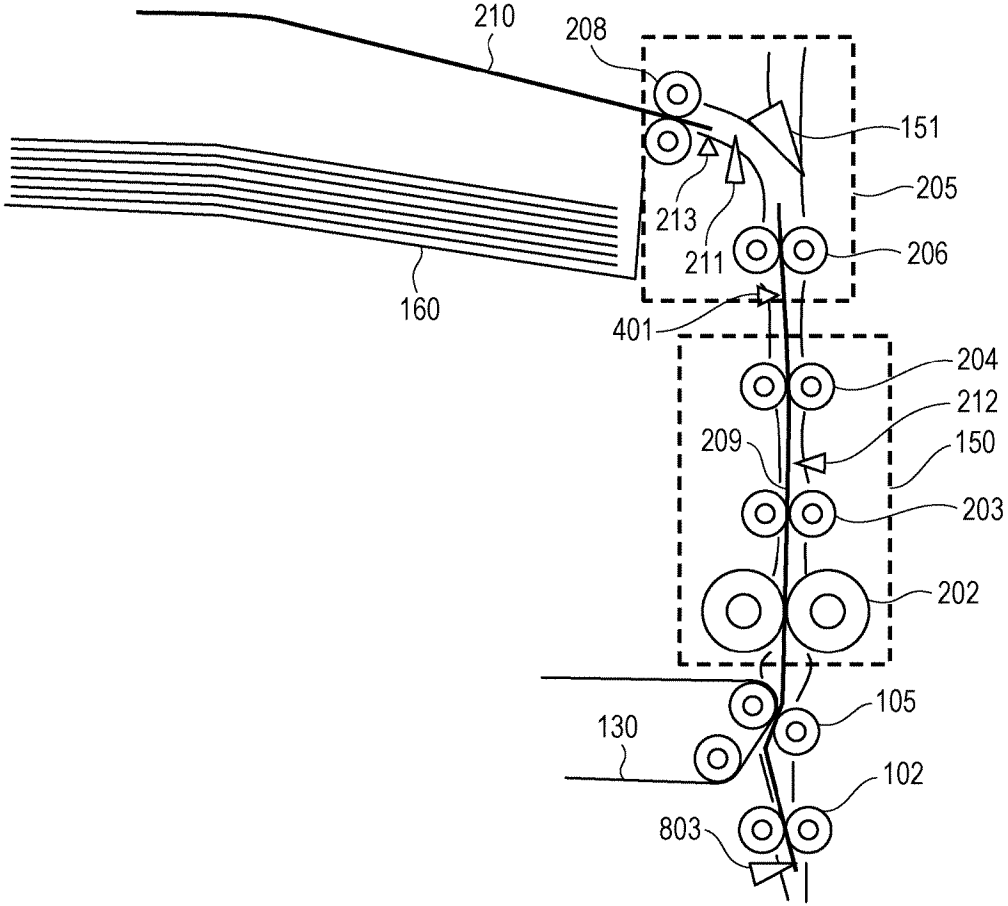
FIG. 7 is a cross-sectional view of an image forming apparatus according to Other Embodiment.

In the embodiment described above, the recognition unit 705 of the control unit 704 recognizes the length of the conveyed sheet on the basis of the input in the operation unit 702 and the signals from the size detection sensor 701 disposed on the container 101. Alternatively, the recognition unit 705 of the control unit 704 may recognize the size of the sheet in the sheet conveyance direction by a sensor disposed on the conveying path. For example, as illustrated in FIG. 7, the registration sensor 803 is disposed upstream of the registration roller pair 102. On the basis of the time after the registration sensor 803 detects the leading end of the sheet, until the registration sensor 803 detects the trailing end of the sheet, the recognition unit 705 of the control unit 704 recognizes the length of the sheet.

The present embodiment has the following effects.

(1) Since the discharge roller pair 208 and the relay roller pair 206 are driven by the same motor, the cost can be reduced as compared with a configuration in which these roller pairs are driven by separate motors.

(2) The discharge roller pair 208 is accelerated from the first speed in accordance with the image forming speed to the second speed which is higher than the first speed. Therefore, printing time is shortened as compared with an apparatus in which no acceleration is conducted. Further, since the distance between the preceding sheet 210 and the subsequent sheet 209 is elongated by the acceleration, the subsequent sheet 209 is detected by the detection sensor more reliably. Further, since the distance between the preceding sheet 210 and the subsequent sheet 209 is elongated by the acceleration, the sheet is guided by the swing guide 151 more reliably.

(3) The discharge roller pair 208 releases the sheet onto the discharge tray 160 with the discharge roller pair 208 which had been accelerated to the second speed being decelerated to the lower first speed. Therefore, stackability (alignment property) in the discharge tray 160 is favorable.

(4) The first control and the second control are conducted selectively. Therefore, a long size sheet can be conveyed with a short distance between sheets while achieving the above-described effects (1), (2) and (3). Therefore, productivity is high. Further, since it is not necessary to excessively increase the second speed during acceleration with a short distance between sheets, operation noise is not large.

Second Embodiment

A second embodiment is described. In the first embodiment, the first control and the second control are switched depending on the length of the sheet. The second embodiment differs from the first embodiment in that the first control and the second control are switched depending on whether the apparatus is in a normal mode or a mode in which a distance between sheets is increased. The difference from the first embodiment will be described in detail and the same configuration is not described.

In the first embodiment, in the same size group, productivity is the same irrespective of the length of the sheet and the distance between sheets varies depending on the length of the sheet. In the second embodiment, the distance between sheets is controlled to be constant irrespective of the length of the sheet in the normal mode. That is, in the second embodiment, productivity varies depending on the length of the sheet in the normal mode.

In the normal mode, a discharge motor 703 is decelerated at timing at which the leading end of a subsequent sheet 209 reaches a second position 401. Here, an image forming apparatus of the second embodiment can shift to a mode in which productivity is lowered temporarily to prevent temperature rise in a fixing roller pair 202 (a down sequence mode in which the distance between sheets is elongated as compared with that in the normal mode). For example, when the temperature at an end portion of the fixing roller pair 202 rises as short size (in the width direction) sheets are conveyed continuously, the apparatus shifts to the mode in which productivity is lowered. When the apparatus shifts to the mode in which productivity is lowered (the down sequence mode), the discharge motor 703 is decelerated when a trailing end of a preceding sheet 210 reaches a first position 213.

If the sheet conveyed by the discharge roller pair 208 is the last sheet (i.e., there is no subsequent sheet), the discharge motor 703 is decelerated when the trailing end of the preceding sheet 210 reaches the first position 213.

Figure 8:
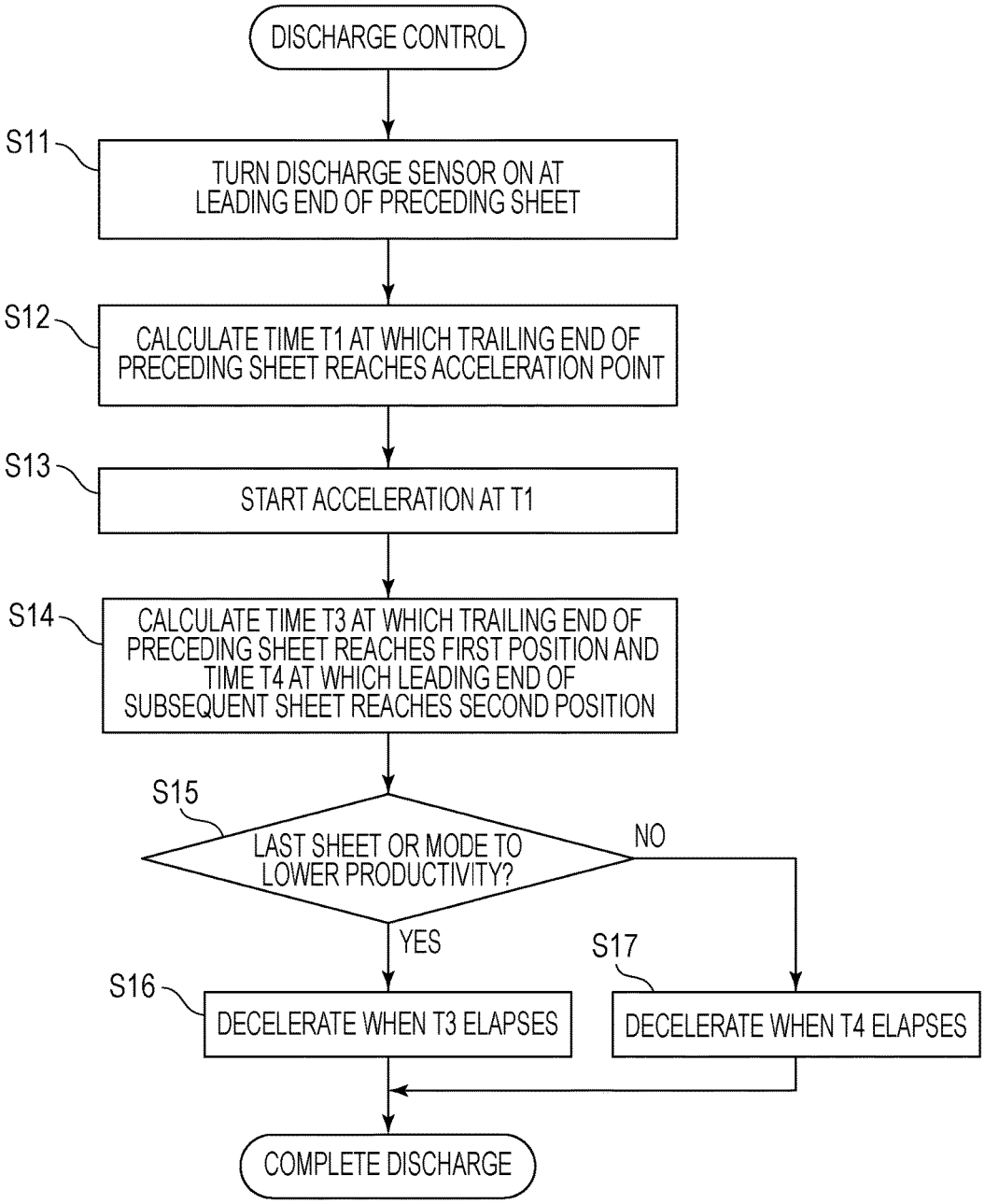
FIG. 8 is a flowchart of control related to a discharging operation of a sheet according to a second embodiment.

Control of a control unit 704 is described with reference to the flowchart in the second embodiment illustrated in FIG. 8.

The control unit 704 controls the discharge motor 703 so that the conveyance speed of a relay roller pair 206 and a discharge roller pair 208 becomes the same as the conveyance speed (the image forming speed) of a fixing apparatus 150. In this example, the conveyance speed of the relay roller pair 206 and the discharge roller pair 208 is the same as the image forming speed. However, it is only necessary that no image defect occurs or the sheet is not damaged when the sheet being conveyed by the fixing apparatus 150 at the image forming speed is conveyed by the relay roller pair 206 and the discharge roller pair 208. That is, the conveyance speed of the relay roller pair 206 and the discharge roller pair 208 here may be slightly higher or lower than the image forming speed.

The control unit 704 confirms that a discharge sensor 211 is turned on by a leading end of a preceding sheet 210 conveyed by the fixing apparatus 150 and the relay roller pair 206 (S11). On the basis of the length of the sheet in the conveyance direction, the control unit 704 calculates time T1 until the trailing end of the sheet reaches an acceleration point 212 which is a predetermined position (S12). When a trailing end of the preceding sheet 210 reaches the acceleration point 212, the control unit 704 controls the discharge motor 703 so that the conveyance speed of the relay roller pair 206 and the discharge roller pair 208 is increased to a second speed which is higher than a first speed (S13). The control unit 704 determines the length of the sheet on the basis of user input from an operation unit 702 or by signals from a size detection sensor 701.

The control unit 704 calculates predicted time T3 after the leading end of the preceding sheet 210 turns the discharge sensor 211 on, until the trailing end of the preceding sheet 210 reaches a first position 213 (S14). The control unit 704 calculates predicted time T4 after the leading end of the preceding sheet 210 turns the discharge sensor 211 on, until the leading end of the subsequent sheet 209 reaches a second position 401 (S14).

The control unit 704 determines whether the apparatus is in the mode in which productivity is lowered or the sheet is the last sheet (S15). If the determination result in S15 is affirmative, i.e., if the sheet is the last sheet or the apparatus is in the mode in which productivity is lowered, the control unit 704 decelerates the discharge motor 703 when control unit 704 determines that the predicted time T3 elapsed (S16). If the determination result in S15 is negative, i.e., if the sheet is not the last sheet or the apparatus is not in the mode in which productivity is lowered, the control unit 704 decelerates the discharge motor 703 when control unit 704 determines that the predicted time T4 elapsed (S17). The control unit 704 decelerates the discharge motor 703 so that the conveyance speed of the relay roller pair 206 and the discharge roller pair 208 becomes the first speed which corresponds to the conveyance speed of the fixing apparatus 150. The sheet is discharged by the decelerated discharge roller pair 208 onto the discharge tray 160.

In the first and the second embodiments, becoming timing at which the trailing end of the sheet reaches the first position 213 is determined in the following manner. The predicted time T3 since the leading end of the preceding sheet 210 turns the discharge sensor 211 on, until the trailing end of the preceding sheet 210 reaches the first position 213 is calculated. After the discharge sensor 211 is turned on, in response that the predicted time T3 is elapsed, the control unit 704 determines that the timing at which the trailing end of the sheet reaches the first position 213 has become. However, the method for determining timing at which the trailing end of the sheet reaches the first position 213 is not limited to that described above. For example, the predicted time since a sensor near the registration roller pair 102 is turned on may be employed instead of the predicted time since the discharge sensor 211 is turned on. The control unit 704 may determine the timing at which the trailing end of the sheet will reach the first position 213 on the basis of the start of the image formation. Similarly, the timing at which the leading end of the sheet reaches the second position 401 may be, for example, the predicted time after a sensor near the registration roller pair 102 is turned on instead of the predicted time T4 since the discharge sensor 211 is turned on. The control unit 704 may determine the timing at which the leading end of the sheet will reach the second position 401 on the basis of the start of the image formation.

In the first and the second embodiments, the following method is employed to determine the timing at which the sheet is accelerated to the second speed from the first speed. The control unit 704 calculates the predicted time T1 after the leading end of the sheet turns the discharge sensor 211 on, until the trailing end of the sheet reaches the acceleration point 212. The control unit 704 then determines the timing at which acceleration is conducted from the first speed to the second speed in response that the predicted time T1 elapsed after the discharge sensor 211 is turned on. The method for determining the timing at which acceleration is conducted from the first speed to the second speed is not limited to that described above. For example, a sensor may be provided at the acceleration point 212 and, when the sensor detects the trailing end of the sheet, the control unit 704 may accelerate to the second speed from the first speed. Instead of the predicted time T1 from turning on of the discharge sensor 211, predicted time after turning on of a sensor near the registration roller pair 102 may be employed.

In the above embodiment, an electrophotographic image forming unit is illustrated as an image forming unit which forms an image on a sheet while conveying at an image forming speed. However, the present invention is applicable also to, for example, an inkjet image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-176861, filed Sep. 8, 2015, which is hereby incorporated by reference herein in its entirety.

What is claimed is:

1. An image forming apparatus comprising:

an image forming unit configured to form an image on a sheet while conveying the sheet at an image forming speed;

a discharge roller pair configured to discharge the sheet on which the image is formed by the image forming unit;

a conveyance roller pair disposed between the image forming unit and the discharge roller pair, and configured to convey the sheet from the image forming unit to the discharge roller pair;

a motor configured to drive the discharge roller pair and the conveyance roller pair; and a control unit configured to control the motor to switch a speed of the conveyance roller pair and the discharge roller pair between a first speed corresponding to the image forming speed and a second speed which is higher than the first speed, wherein the control unit is configured to perform first control and second control, wherein, in first control, the motor is controlled in a manner such that the speed of the conveyance roller pair and the discharge roller pair is switched from the second speed to the first speed at timing at which a trailing end of a first sheet being conveyed by the discharge roller pair reaches a first position between the discharge roller pair and the conveyance roller pair and before a leading end of a second sheet fed following the first sheet being conveyed by the discharge roller pair reaches a second position upstream of the conveyance roller pair, and wherein, in second control, the motor is controlled in a manner such that the speed of the conveyance roller pair and the discharge roller pair is switched from the second speed to the first speed at timing at which a leading end of a subsequent sheet fed following a preceding sheet being conveyed by the discharge roller pair reaches the second position and before the trailing end of the preceding sheet reaches the first position.

2. The image forming apparatus according to claim 1, further comprising an obtaining unit configured to obtain a length of the sheet being conveyed, wherein the control unit switches between the first control and the second control depending on the length of the sheet in a conveyance direction obtained by the obtaining unit.

3. The image forming apparatus according to claim 1, wherein, in at least a group including sheets of the same productivity and of a plurality of lengths, the control unit conducts the first control if the length of the sheet in the conveyance direction is shorter than a predetermined length, and the control unit conducts the second control if the length of the sheet in the conveyance direction is longer than the predetermined length.

4. The image forming apparatus according to claim 1, wherein the control unit conducts the second control in a normal mode and conducts the first control in a mode in which a distance between sheets is longer than that in the normal mode.

5. The image forming apparatus according to claim 1, wherein the control unit conducts the first control in a manner such that the speed of the discharge roller pair is the first speed when the trailing end of the first sheet passes through the discharge roller pair, and wherein the control unit conducts the second control in a manner such that the speed of the discharge roller pair is the first speed when the trailing end of the proceeding sheet passes through the discharge roller pair.

6. The image forming apparatus according to claim 1, wherein the control unit conducts the first control if the sheet conveyed by the discharge roller pair is the last sheet.

7. The image forming apparatus according to claim 1, further comprising a detection unit configured to detect the sheet between the image forming unit and the discharge roller pair, wherein the control unit controls the motor to change to the second speed from the first speed based on a detection result of the detection unit.

8. The image forming apparatus according to claim 1, further comprising:

a branching conveying path branched from a portion between the image forming unit and the discharge roller pair; and a guide portion movable between a position to guide the sheet fed from the image forming unit to the discharge roller pair, and a position to guide the sheet to the branching conveying path.

9. The image forming apparatus according to claim 1, wherein the control unit controls the motor in a manner such that (i) the speed of the discharge roller pair is switched from the first speed to the second speed after the trailing end of the first sheet passes through the image forming unit, (ii) the speed of the discharge roller pair is switched from the second speed to the first speed while the discharge roller pair nips the first sheet, and (iii) the speed of the discharge roller pair is the first speed when the trailing end of the first sheet passes through the discharge roller pair.

10. The image forming apparatus according to claim 1, wherein the image forming unit includes a fixing apparatus configured to fix, to the sheet, the toner image transferred to the sheet, while conveying the sheet at the image forming speed.

11. An image forming apparatus, comprising:

a fixing portion configured to fix, to a sheet, a toner image transferred to the sheet while conveying the sheet at a predetermined speed;

a discharge roller pair configured to discharge the sheet to which the image is fixed by the fixing portion;

a conveyance roller pair disposed between the fixing portion and the discharge roller pair, and configured to convey the sheet from the fixing portion to the discharge roller pair;

a motor configured to drive the discharge roller pair and the conveyance roller pair; and a control unit configured to control the motor so that a conveyance speed of the conveyance roller pair and the discharge roller pair is changed between a first speed which corresponds to the predetermined speed and a second speed which is higher than the first speed, wherein the control unit is configured to perform first control and second control, wherein, in first control, the motor is controlled in a manner such that (i) the speed of the conveyance roller pair and the discharge roller pair is switched from the first speed to the second speed after a preceding sheet has passed through the fixing portion, (ii) and the speed of the conveyance roller pair and the discharge roller pair is switched from the second speed to the first speed at timing at which a trailing end of the preceding sheet being conveyed by the discharge roller pair reaches a first position between the discharge roller pair and the conveyance roller pair and before a leading end of a succeeding sheet fed following the preceding sheet being conveyed by the discharge roller pair reaches a second position upstream of the conveyance roller pair, and wherein, in second control, the motor is controlled in a manner such that (iii) the speed of the conveyance roller pair and the discharge roller pair is switched from the first speed to the second speed after a preceding sheet has passed through the fixing portion, (iv) the speed of the conveyance roller pair and the discharge roller pair is switched from the second speed to the first speed at timing at which a leading end of a subsequent sheet fed following the preceding sheet being conveyed by the discharge roller pair reaches the second position and before the trailing end of the preceding sheet reaches the first position.

12. The image forming system according to claim 11, further comprising an obtaining unit configured to obtain the length of the sheet being conveyed, wherein the control unit switches between the first control and the second control depending on the length of the sheet in the conveyance direction obtained by the obtaining unit.

13. The image forming system according to claim 11, wherein, in at least a group including sheets of the same productivity and of a plurality of lengths, the control unit conducts the first control if the length of the sheet in the conveyance direction is shorter than a predetermined length, and the control unit conducts the second control if the length of the sheet in the conveyance direction is longer than the predetermined length.

14. The image forming apparatus according to claim 11, wherein the control unit conducts the second control in a normal mode and conducts the first control in a mode in which a distance between sheets is longer than that in the normal mode.

15. The image forming system according to claim 11, wherein the control unit conducts the first control in a manner such that the speed of the discharge roller pair is the first speed when the trailing end of the preceding sheet passes through the discharge roller pair, and wherein the control unit conducts the second control in a manner such that the speed of the discharge roller pair is the first speed when the trailing end of the preceding sheet passes through the discharge roller pair.

16. The image forming apparatus according to claim 11, wherein the control unit conducts the first control when the sheet conveyed by the discharge roller pair is the last sheet.

17. The image forming system according to claim 11, further comprising a detection unit configured to detect a sheet between the image forming unit and the discharge roller pair, wherein the control unit controls the motor to change to the second speed from the first speed based on a detection result of the detection unit.

18. The image forming apparatus according to claim 11, further comprising:

a branching conveying path branched from a portion between the image forming unit and the discharge roller pair; and a guide portion movable between a position to guide the sheet fed from the image forming unit to the discharge roller pair, and a position to guide the sheet to the branching conveying path.

19. The image forming system according to claim 11, wherein the control unit controls the motor in a manner such that (i) the speed of the discharge roller pair is switched from the first speed to the second speed after the trailing end of the preceding sheet passes through the image forming unit, (ii) the speed of the discharge roller pair is switched from the second speed to the first speed while the discharge roller pair nips the preceding sheet, and (iii) the speed of the discharge roller pair is the first speed when the trailing end of the preceding sheet passes through the discharge roller pair.

* * * * *